United States Patent [19]

Jones et al.

[11] Patent Number: 4,541,356

[45] Date of Patent: Sep. 17, 1985

[54] MULTIHULL VESSEL WITH CAPSIZE PREVENTION MEANS

[76] Inventors: Tristan Jones, 9 Bow St., London WCZE7AL, England; Leo Surtees, 73 Garden St., Tamworth, New South Wales, 2340, Australia

[21] Appl. No.: 611,715

[22] Filed: May 18, 1984

[51] Int. Cl.[4] ..... B63B 43/06

[52] U.S. Cl. ..... 114/61; 114/122; 114/125; 114/140; 114/360

[58] Field of Search ..... 114/121, 122, 125, 61, 114/140, 142, 360, 39

[56] References Cited

U.S. PATENT DOCUMENTS

| | | | |
|---|---|---|---|
| 603,469 | 5/1898 | Kautz | 114/123 |
| 650,333 | 5/1900 | Martens | 114/125 X |
| 1,444,150 | 2/1923 | Gadomski | 114/125 |
| 2,736,608 | 2/1956 | Martin | 299/136 |
| 2,757,629 | 8/1956 | Wiltse | 114/125 |
| 2,997,974 | 8/1961 | Hamlin | 114/142 |
| 3,094,959 | 6/1963 | Fox | 114/61 |
| 3,137,263 | 6/1964 | Sainte-Claire | 114/125 |
| 3,727,573 | 4/1973 | Prohaska | 114/122 |
| 4,217,845 | 8/1980 | Hood et al. | 114/125 |

*Primary Examiner*—Sherman D. Basinger

*Attorney, Agent, or Firm*—Hopgood, Calimafde, Kalil, Blaustein & Judlowe

[57] ABSTRACT

A capsize prevention device for a multihull vessel which may be mounted to an existing vessel or be integrally manufactured therewith. The device includes first and second tubes disposed longitudinally along the lower portion of the keel of the vessel through which seawater flows during the sailing of the vessel. Each of the tubes includes forward and rearward watertight valves. When the valves are open, water is free to flow through the tubes. When the valves are closed, water will be trapped within the tubes, thus adding the mass of the trapped water to the keel. The mass of the water within the tubes serves to prevent capsize about one of the outriggers of the vessel.

8 Claims, 4 Drawing Figures

MULTIHULL VESSEL WITH CAPSIZE PREVENTION MEANS

BACKGROUND OF THE INVENTION

The present invention relates generally to multihull sailing vessels and, more particularly, to an improved device for preventing the capsize of such vessels. The device may be either fitted to an existing vessel or be formed integrally therewith.

Multihull sailing vessels such as catamarans, trimarans and proas, are becoming increasingly popular for recreational sailing. However, such vessels are particularly susceptible to complete capsizing due to their multihull design. When these vessels capsize, they pivot about one of the outriggers, and capsizing may occur even under the hand of an experienced sailor. While a number of proposals have been made to solve the capsizing of such vessels, such proposals have been less than completely satisfactory, in that the solutions were either too expensive, ineffective or adversely effected the handling of the vessel. The present invention is directed to overcoming these difficulties.

The present invention is directed to a capsize prevention device for multihull vessels that may be built integrally with the vessel or added to an existing vessel. First and second tubes through which water may flow are disposed longitudinally along the lower portion of the vessel's keel. Disposed at the forward and rearward end of each of the tubes are valves which may be either opened to permit sea water to flow through the tubes or closed to entrap any sea water flowing through the tubes. The valves may be operated either manually or through an automatic device which detects excessive heel angle of the vessel. When the valves are closed, the water thus becomes entrapped in the tubes and as the vessel heels over, the mass of the water is added to the keel of the vessel. As the keel attempts to rise out of the water, the mass of the water combined with the leverage arm formed between the outrigger and the keel provides an anti-capsizing torque to the vessel.

Accordingly, it is an object of this invention to provide an improved multihull sailing vessel.

It is a further object of this invention to provide a multihull vessel including an anti-capsizing device.

It is a further object of this invention to provide an anti-capsizing device for a multihull vessel that may be integral with the vessel or attached to an existing vessel.

It is a further object of this invention to provide an anti-capsizing device for a multihull vessel that will not adversely effect the handling of the vessel when not in use.

It is another object of this invention to provide an improved anti-capsizing device that may be either manually or automatically actuated.

Other objects of this invention will become apparent upon a reading of the detailed specification to follow.

BRIEF DESCRIPTION OF THE DRAWINGS

In order to better understand the invention, reference is made to the following description of the drawings which are to be taken in conjunction with the detailed description to follow.

DESCRIPTION OF THE PREFERRED EMBODIMENTS

Figure 1:
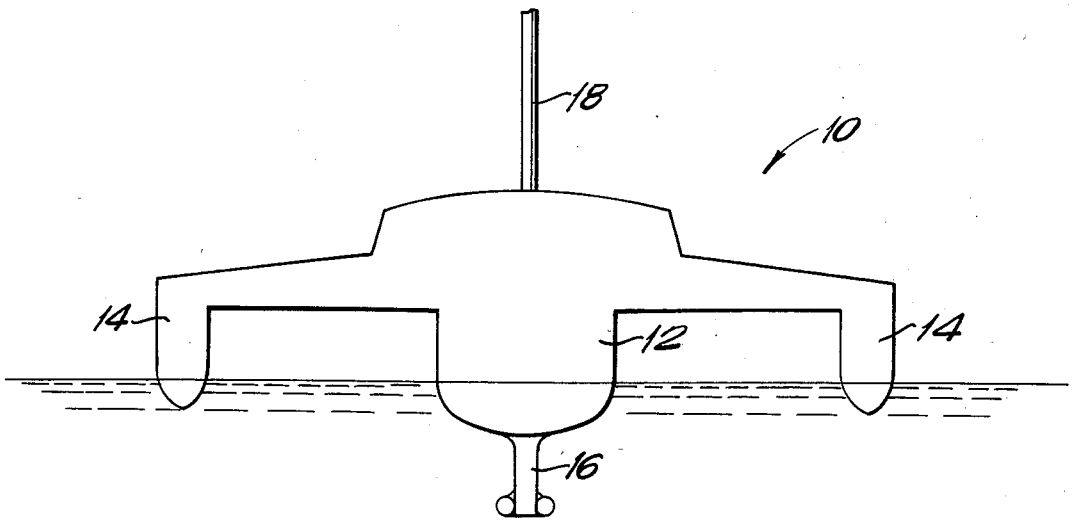
FIG. 1 illustrates a trimaran including an anti-capsizing device constructed in accordance with the present invention, in which the vessel is sailing in a normal condition.

The drawings illustrate a multihull vessel including a capsize prevention device as applied to a trimaran 10. The device is applicable to various other types of multihull vessels such as catamarans, proas, and the like. Trimaran 10 includes a central hull 12, outriggers 14, keel 16 and a mast 18. Located horizontally and longitudinally along the lower edge of keel 16 are a first tube 20 and a second tube 22 which extend the length of the keel. Disposed at each end of tube 20 is a forward butterfly valve 24 and a rearward butterfly valve 26. Similarly, tube 22 includes a forward butterfly valve 28 and a rearward butterfly valve 30. Tubes 20, 22 may be attached to keel 16 by either a mounting bracket 29 or be integrally formed therewith. A fairing 31 may be used to streamline the keel/tube interface.

Each butterfly valve 24, 26, 28 and 30 consists of a disc 32 dimensioned to provide a watertight closing of the tube in which it is mounted. Each disc 32 is mounted to a rotating vertical shaft 34 which extends out of the upper part of the tube. Attached at the upper end of shaft 34 is a crank arm 36. Push/pull rods 40, 38 extend outside of tubes 20, 22 and couple the crank arms 36 disposed in each tube together for synchronized rotation of discs 32. Crank arms 36 on rearward butterfly valves 26, 30 are joined by a tie rod 42. Located behind the rearward end of keel 16 and hingedly coupled to tie rod 42 is a lever arm 44 which is joined to a rotatable shaft 46 which is vertically mounted and extends through hull 12. A universal joint 48 is located in shaft 46 to provide for convenient positioning and a stuffing gland 49 seals the interface between hull 12 and shaft 46.

The opening and closing of butterfly valves 24, 26, 28 and 30 are controlled by the rotation of shaft 46. When shaft 46 is rotated, crank arm 44 will be rotated to laterally displace tie rod 42 which is coupled to crank arms 36 of rearward butterfly valves 26, 30. In turn, push/pull rods 40, 38 will control the opening and closing of forward butterfly valves 24, 28. When discs 32 are disposed perpendicularly to the longitudinal axes of tubes 20, 22, the water flowing through tubes 20, 22 during the motion of the vessel will be prevented from escaping. Conversely, when discs 32 are parallel to the longitudinal axes of tubes 20, 22, water will be free to flow through tubes 20, 22 with minimal effect on the sailing of trimaran 10.

The rotation of shaft 46 in order to close tubes 20, 22 may either be manually controlled, powered by an electric motor 50 coupled to power supply 51, which is under the command of the ship's operator by closing a switch 52 or may be automatically controlled by a device 54 for sensing the angle of heel of the boat. Heel angle sensing device 54 can be a mercury switch which is closed when the boat heels over at any predetermined angle and many other types of angle sensing devices may be used. A suitable triggering angle for the operation of the device is 15°, however, any other angle may be set by the operator of the vessel. Upon the closing of angle sensing device 54, motor 50 will rotate shaft 46 to close tubes 20, 22.

When trimaran 10 is sailing at a normal angle, as shown in FIG. 1, butterfuly valves 24, 26, 28, 30 will be open and water will flow freely through tubes 20, 22 and the sailing of trimaran 10 will be substantially undisturbed. However, when angle sensor 54 detects excess heel angle and actuates motor 50, shaft 46 is rotated to close the butterfly valves. The water contained within tubes 20, 22 will be sealed therein, thus adding the mass of the water to the keel of the boat to prevent capsizing.

Figure 2:
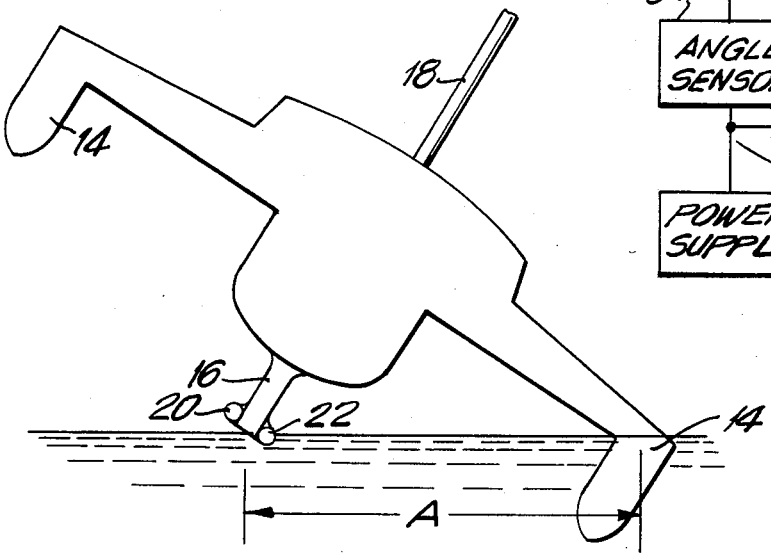
FIG. 2 illustrates the trimaran including the instant invention approaching capsize.
Figure 3:
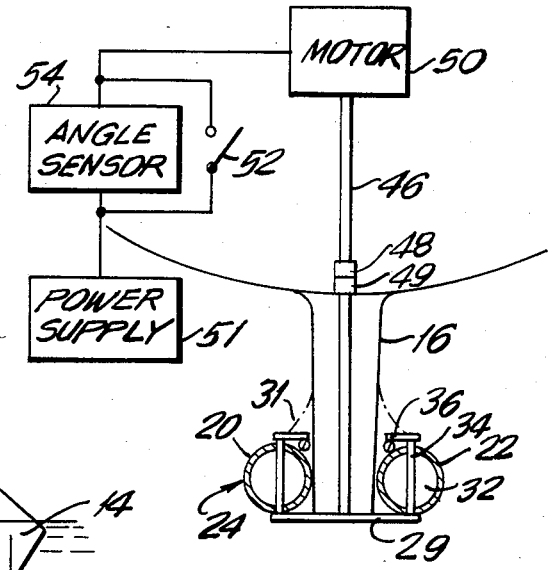
FIG. 3 is a view from the rear of the hull and keel of a vessel including the anti-capsizing device and its actuation and control mechanisms.
Figure 4:
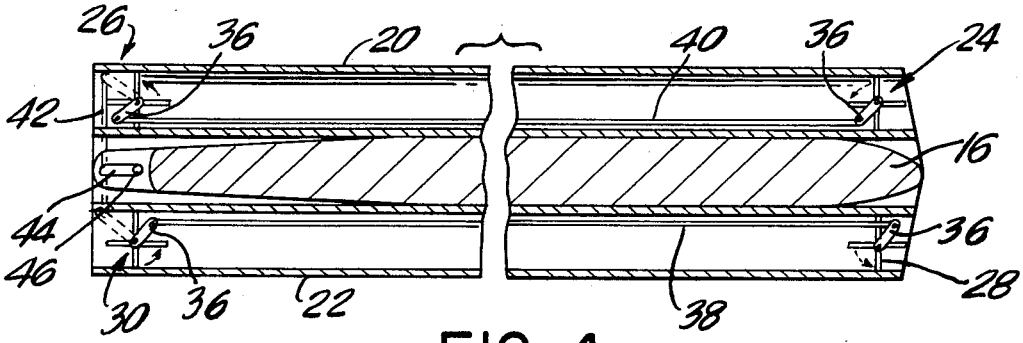
FIG. 4 is a cut away view looking upwardly towards the bottom of a vessel including the anti-capsizing device.

This anti-capsizing action is illustrated in Fig. 2 which illustrates trimaran 10 in a dangerously heeled over condition with the possibility of capsize by pivoting about outrigger 14. In this condition, shaft 46 would already have been rotated by motor 50 under control of angle sensor 54 or manually actuated to close tubes 20, 22. As tubes 20, 22 attached to keel 16 attempt to come out of the water, the weight of the water contained therein will provide a righting torque to trimaran 10 to resist capsizing. The anti-capsizing torque supplied by the water contained in tubes 20, 22 is substantial due to the leverage affect. For example, if tubes 20, 22 are six inches in outer diameter, and seven feet long, they will each contain 87.68 pounds of water. If the distance A between the central line of outrigger 14 and keel 16 is 12 feet, the ballasting affect of the water within the tubes will be 2,111 foot pounds (2 tubes$\times$87.68 lbs$\times$12 ft). This amount of torque is substantial when applied to a trimaran hull.

The present invention is applicable to multihull designs of many different types. The dimensions of the tube can be varied to accommodate the type and size of vessel to which they are attached and the amount of anti-capsizing force desired. Furthermore, the valves used to seal the tubes may be of many different types and the anti-capsizing arrangement may be either constructed integrally with the vessel or be a separate attachable system.

Although the present invention has been described in conjunction with a preferred embodiment, it is to be understood that modifications and variations may be resorted to without departing from the spirit and scope of the invention, as those skilled in the art will readily understand. Such modifications and variations are considered to be within the purview and scope of the invention and the appended claims.

What is claimed is:

1. A capsize prevention device for a multihull vessel having a keel, said device comprising:

first and second tube means disposed longitudinally along opposed sides of the keel;

valve means disposed at each end of said first and second tubes, said valve means being displaceable between a first open position and a second closed position, said valve means when in said first open position being effective to permit water to flow through said tubes, and when in said second closed position to retain water therein; and means responsive to the relative heel angle of the keel for displacing said valves from said first position to said second position.

2. The capsize prevention device as claimed in claim 1, in which said valve displacing means includes heel angle detection means and automatic means for closing said valves, said automatic closing means being activated upon detection by said heel angle detection means of a heel angle exceeding a predetermined value.

3. The capsize prevention device as claimed in claim 2, wherein said automatic means for closing said valve means comprise an electric motor and said heel angle detection means comprise a mercury switch which is closed at a predetermined angle of heel.

4. The capsize prevention device as claimed in claim 1, wherein said valve means comprises a butterfly valve rotatable from said first to said second position.

5. The capsize prevention device as claimed in claim 4, further including a mechanical linkage of the butterfly valves in each of said tubes for synchronized rotation.

6. The capsize prevention device as claimed in claim 4, wherein at least one pair of butterfly valves on opposed sides of said keel are linked together for rotation.

7. The capsize prevention device as claimed in claim 1, wherein said first and second tube means are mounted to a bracket mountable to the keel of a vessel.

8. The capsize prevention device as claimed in claim 1, further including fairing means disposed about said first and second tube means to streamline same.

* * * * *